US007654119B2

(12) United States Patent
Song

(10) Patent No.: US 7,654,119 B2
(45) Date of Patent: Feb. 2, 2010

(54) DETERGENT SUPPLYING APPARATUS OF WASHING MACHINE

(75) Inventor: Hyung Ju Song, Daegu-si (KR)

(73) Assignee: LG Electronics Inc., Seoul (KR)

( * ) Notice: Subject to any disclaimer, the term of this patent is extended or adjusted under 35 U.S.C. 154(b) by 550 days.

(21) Appl. No.: 11/476,210

(22) Filed: Jun. 28, 2006

(65) Prior Publication Data

US 2007/0056329 A1 Mar. 15, 2007

(30) Foreign Application Priority Data

Jun. 29, 2005 (KR) ..... 10-2005-0057182

(51) Int. Cl.
*D06F 39/02* (2006.01)

(52) U.S. Cl. ..... 68/17 R; 68/207

(58) Field of Classification Search ..... 68/17 R, 68/207; 134/93
See application file for complete search history.

(56) References Cited

U.S. PATENT DOCUMENTS 4,190,181 A * 2/1980 Arnaud ..... 222/456
6,227,012 B1 * 5/2001 Borroni et al. ..... 68/17 R
7,093,467 B2 * 8/2006 Kim et al. ..... 68/17 R
7,254,966 B2 * 8/2007 Kim et al. ..... 68/17 R
2003/0041389 A1 * 3/2003 Cheo et al. ..... 8/158
2003/0172690 A1 * 9/2003 Kim et al. ..... 68/17 R
2004/0103696 A1 * 6/2004 Kim et al. ..... 68/17 R
2004/0159128 A1 * 8/2004 Kim et al. ..... 68/17 R
2005/0097925 A1 * 5/2005 Kim et al. ..... 68/12.18
2005/0188730 A1 * 9/2005 Zsambeki ..... 68/17
2005/0274156 A1 * 12/2005 Yang ..... 68/17 R
2005/0274157 A1 * 12/2005 Yang ..... 68/17 R

FOREIGN PATENT DOCUMENTS

DE 21226240 A 8/1972
DE 8220740 U1 10/1982
DE 10122514 A1 3/2002
EP 169604 A2 * 1/1986

* cited by examiner

*Primary Examiner*—Joseph L Perrin
(74) *Attorney, Agent, or Firm*—McKenna Long & Aldridge LLP

(57) ABSTRACT

Disclosed herein is a detergent supplying apparatus of a washing machine comprising a drawer partitioned so that either of a bleach supplying part and a softener supplying part is positioned at a side and a front of the other. The present invention enables the drawer to be made compact, and softener and bleach to be injected with the drawn width of the drawer minimized.

15 Claims, 11 Drawing Sheets

DETERGENT SUPPLYING APPARATUS OF WASHING MACHINE

This Non-provisional application claims priority under 35 U.S.C. § 119(a) on Patent Application No. 10-2005-0057182 filed in Korea on Jun. 29, 2005, the entire contents of which are hereby incorporated by reference.

BACKGROUND OF THE INVENTION

1. Field of the Invention

The present invention relates to a detergent supplying apparatus of a washing machine having a drawer for receiving and supplying detergent which can be drawn to the outside, more particularly, which is capable of minimizing the drawn width of its drawer and injecting breach or softener easily therein.

2. Description of the Background Art

In general, a washing machine refers to a device for cleaning a laundry through washing, rinsing, dewatering, and drying to decontaminate clothes and bedclothes (Hereinafter, referred to as "laundry").

The washing machine is classified as a home washing machine and a commercial washing machine depending on a purpose of use. The home washing machine is installed at each home, and is used for washing the laundry generated by a member of family. The commercial washing machine is separately installed at a shop or dormitory, and is used for leasing its use to a user desiring to wash the laundry in return for a predetermined use fee.

The commercial washing machine is separately provided with a fee processing unit other than a construction of the general home washing machine, and separately requires a control algorithm of the fee processing unit.

The washing machine is provided with a detergent supplying apparatus for housing detergent, bleach, and softener and then, selectively supplying the detergent, the bleach, and the softener at a necessary time.

The detergent supplying apparatus includes a drawer for housing and supplying the detergent, the bleach, and the softener.

The drawer is disposed at a water supplying flow of the washing machine to mix and supply water passing through the water supplying flow of the washing machine, and is constructed such that it is drawn or disengaged outside to input the detergent, the bleach, and the softener.

FIG. 1 is a perspective view illustrating an example of a drawer used in a conventional washing machine. A detergent supplying part 402 to house and supply detergent is long provided in the front and rear direction at a right side of the drawer 400. A bleach supplying part 404 to house and supply bleach is long provided in the front and rear direction at a center of the drawer 400. A softener supplying part 406 to house softener is long provided in the front and rear direction at a left side of the drawer 400.

In the bleach supplying part 404, a bleach siphon tube 408 is protruded, and the bleach siphon tube 408 is covered with a bleach siphon cap 408'.

In the softener supplying part 406, a softener siphon tube 409 is protruded, and the softener siphon tube 409 is covered with a softener siphon cap 409'.

However, in the detergent supplying apparatus of the washing machine according to the prior art, the detergent supplying part 402, bleach supplying part 404, and softener supplying part 406 are arranged in the left and right direction and formed long in the front and rear direction, which causes the overall size of the drawer 400 to be greater, increases manufacturing cost, and makes it difficult to secure a space to install the drawer 400 in the commercial washing machine.

By contrast, If the drawer 400 is formed small, the size of the detergent supplying part 402, bleach supplying part 404, and softener supplying part 404 becomes too small accordingly; there exist problems to cause insufficient accommodation amount of detergent, and fail to sufficiently secure the size of an input port for each of the detergent supplying part 402, bleach supplying part 404, and softener supplying part 404.

FIG. 2 is a perspective view illustrating another example of a drawer used in the conventional washing machine. A detergent supplying part 412 to house detergent is long provided in the front and rear direction at a right side of the drawer 410. A bleach/softener supplying part 414 to separately house bleach and softener is long provided in the front and rear direction at a left side of the drawer 410.

The bleach/softener supplying part 414 is provided with a box shaped bleach supplying part 416 at an inner and front part, and is provided with a box shaped softener supplying part 418 at an inner and rear part.

In the bleach supplying part 416, a bleach siphon tube 428 is protruded, and the bleach siphon tube 428 is covered with a bleach siphon cap 428'.

In the softener supplying part 418, a softener siphon tube 429 is protruded, and the softener siphon tube 429 is covered with a softener siphon cap 429'.

However, in the detergent supplying apparatus of the washing machine according to the prior art, the bleach supplying part 416 and softener supplying part 418 are arranged in the bleach/softener supplying part 414 to be spaced by each other in the front and rear direction, and thus, when softener is injected, the drawer 410 should be drawn until the bleach supplying part 416 and softener supplying part 418 are all open, causing the drawal distance of the drawer 410 to be greatly increased, which also makes the front and rear length of the drawer 410 greatly lengthened.

SUMMARY OF THE INVENTION

The present invention is designed to solve the problems of the prior art, and therefore, it is an object of the present invention to provide a detergent supplying apparatus to be capable of minimizing the size and drawn width of its drawer by forming the drawer with a optimum structure, and easily injecting bleach and softener.

To accomplish the above objects, a detergent supplying apparatus of a washing machine according to the present invention comprises a drawer partitioned so that either of a bleach supplying part and a softener supplying part is positioned at a side and a front of the other.

Each of the bleach supplying part and softener supplying part is formed so that a left and right width of its front part is greater than that of its rear part.

The drawer is formed with a drawer partition rib for partitioning the bleach supplying part and softener supplying part.

The drawer partition rib comprises a first partition rib formed in a left and right direction on an inner and front part of the drawer, a second partition rib formed from the first partition rib rearward, and a third partition rib formed in a left and right direction and in parallel with a part of the first partition rib from the second partition lib, and then formed rearward.

The drawer has a bleach siphon tube protruded upward on the bleach supplying part and a softener siphon tube protruded upward on the softener supplying part with respect to the drawer partition lib.

The drawer has an overflowing part having a relatively lower height than the other parts on a rear wall part of at least either of the bleach supplying part and softener supplying part.

The detergent supplying apparatus of the washing machine further comprises a drawer cap arranged on a top surface of the bleach supplying part and softener supplying part.

The drawer cap has a size to be capable of the overall top surface of the bleach supplying part and softener supplying part.

The drawer is formed so that the bleach supplying part is positioned at a side and a front of the softener supplying part.

The drawer cap is formed so that a bleach input port and a softener input port are positioned in a front and rear direction to be spaced from each other.

The drawer cap has a bleach siphon cap for covering the bleach siphon tube formed on the bleach supplying part and a softener siphon cap for covering the softener siphon tube formed on the softener supplying part.

The drawer cap has a water supplying hole for bleach, through which water is supplied to the bleach supplying part, and a water supplying hole for softener, through which water is supplied to the softener supplying part.

The drawer is formed so that a detergent supplying part is positioned at a side of either of the softener supplying part and bleach supplying part.

The washing machine is a commercial drum type washing machine.

In the detergent supplying apparatus of the washing machine according to the present invention configured as above, either of the softener supplying part and bleach supplying part is formed to be placed at a side and front of the other in the drawer, which allows for making the overall drawer compact while enlarging the size of the detergent supplying part, and allows softener and bleach to be injected while maintaining minimum drawn width of the drawer.

Moreover, each of the bleach supplying part and softener supplying part is formed so that the left and right width of its front side is greater than that of its rear side, which allows bleach and softener to easily injected.

BRIEF DESCRIPTION OF THE DRAWING

The invention will be described in detail with reference to the following drawings in which like numerals refer to like elements.

DETAILED DESCRIPTION OF THE PREFERRED EMBODIMENT

Now, the preferred embodiment of the present invention will be hereinafter described in detail with reference to the accompanying drawings.

Figure 3:
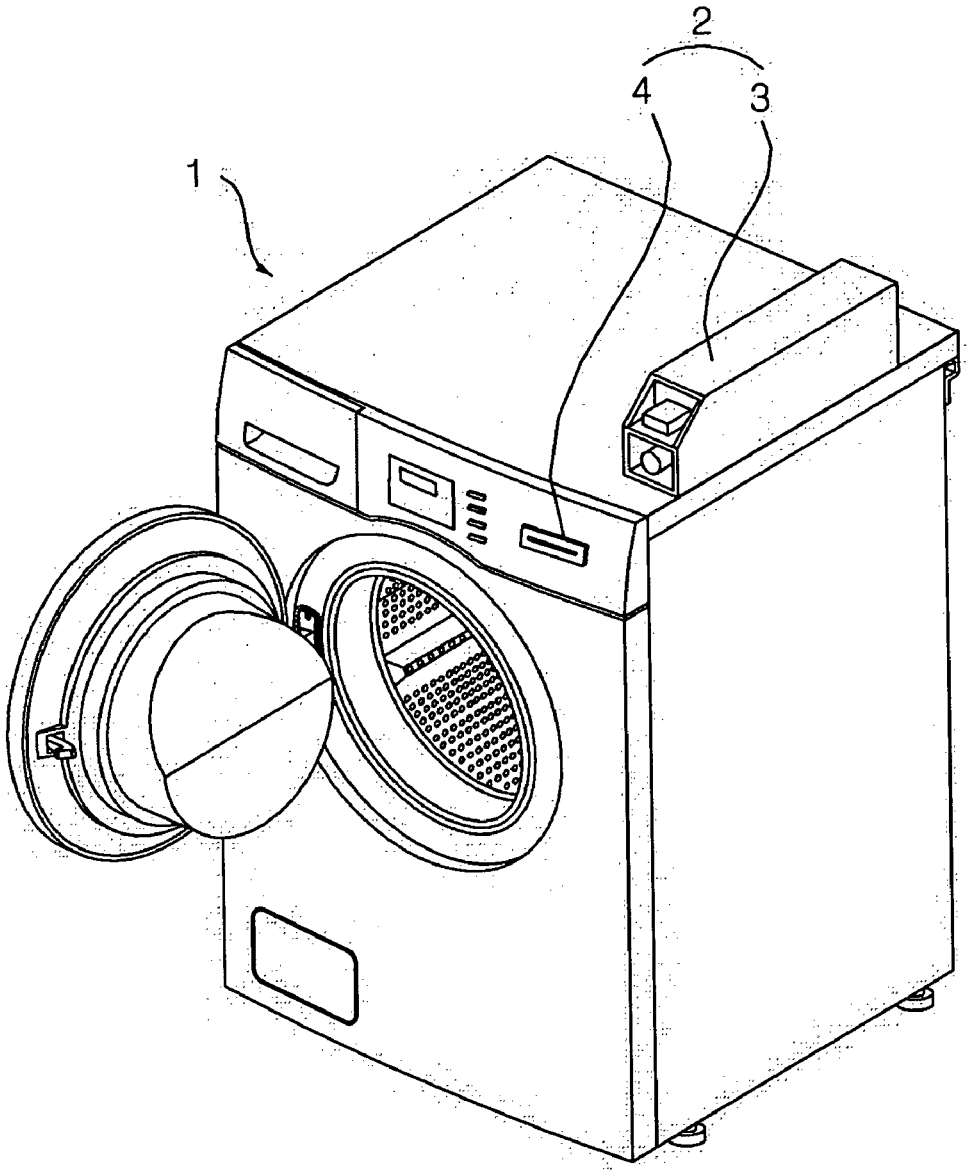
FIG. 3 is a prospective view of illustrating a commercial drum type washing machine to which a detergent supplying apparatus of a washing machine according to the present invention is applied.

FIG. 3 is a prospective view of illustrating a commercial drum washing machine to which a detergent supplying apparatus of a washing machine according to the present invention is applied.

The commercial drum type washing machine 1 shown in FIG. 3, when a desired washing course, time, or the like are selected by an user, accepts payment for appropriate fees by its fee processing device 2 depending on the selected washing course, time, or the like, and then decontaminates dirt on laundry through washing, rinsing, dehydrating, and drying by its mechanical operation together with water mixed with detergent.

The fee processing device 2 consists of a coin box 3 and a card reader 4.

The coin box 3 is a device to settle the payment of fees by coins, which receives a number of coins therein and deals with coins mechanically, therefore, its appearance and weight are formed greatly.

Whereas, the card reader 4 is a device to settle the payment of fees by magnetic cards or IC cards, which is read and processed electronically, therefore, its appearance and weight are formed much smaller than the coin box 3.

On the other hand, the commercial drum type washing machine 1 includes both of the coin box 3 and card reader 4 to enhance users' convenience.

Figure 1:
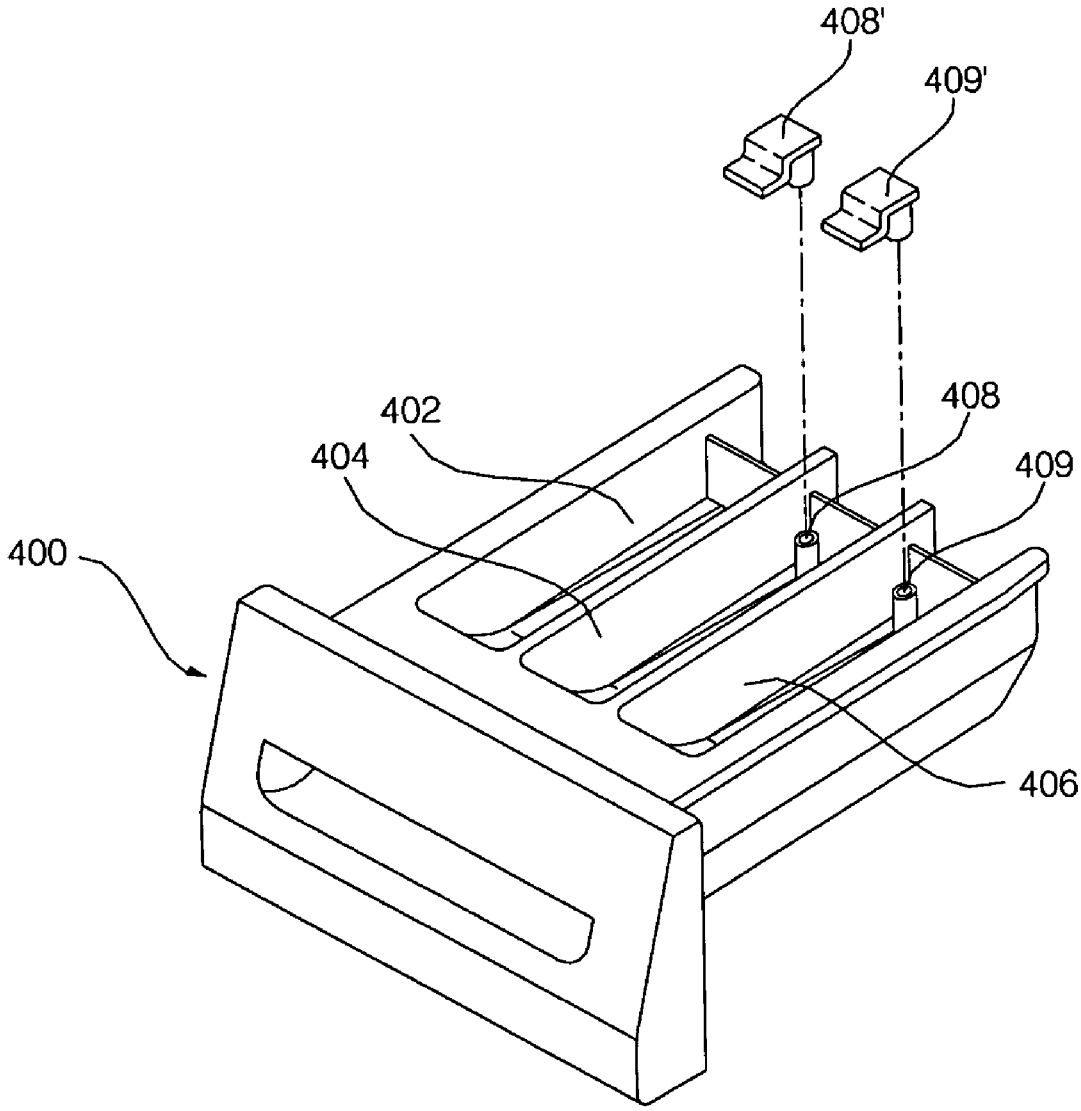
FIG. 1 PRIOR ART
FIG. 1 is a perspective view illustrating an example of a drawer used in a conventional washing machine.
Figure 4:
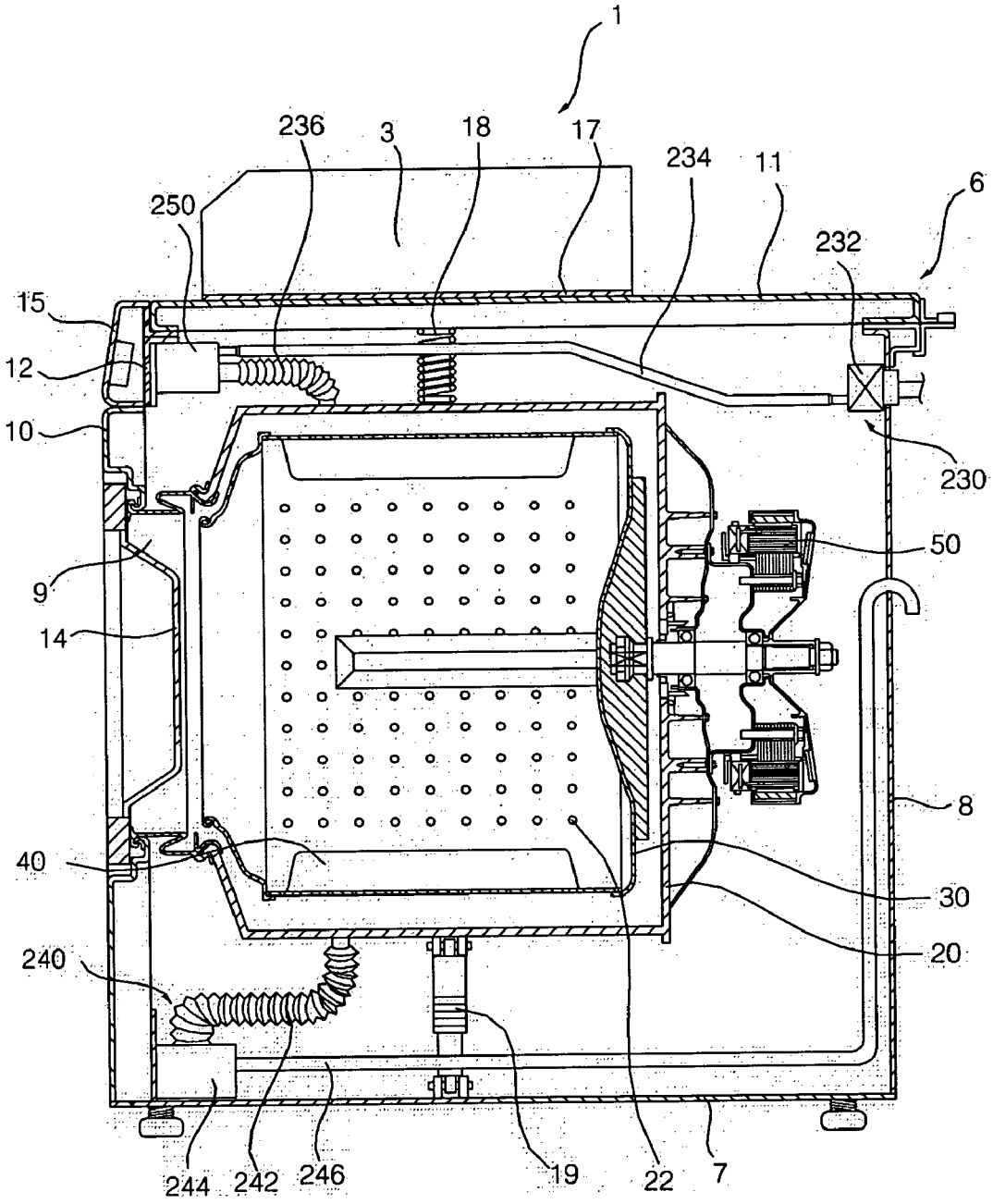
FIG. 4 is a cross-sectional view of illustrating an internal construction of the commercial drum washing machine shown in FIG. 1.
Figure 5:
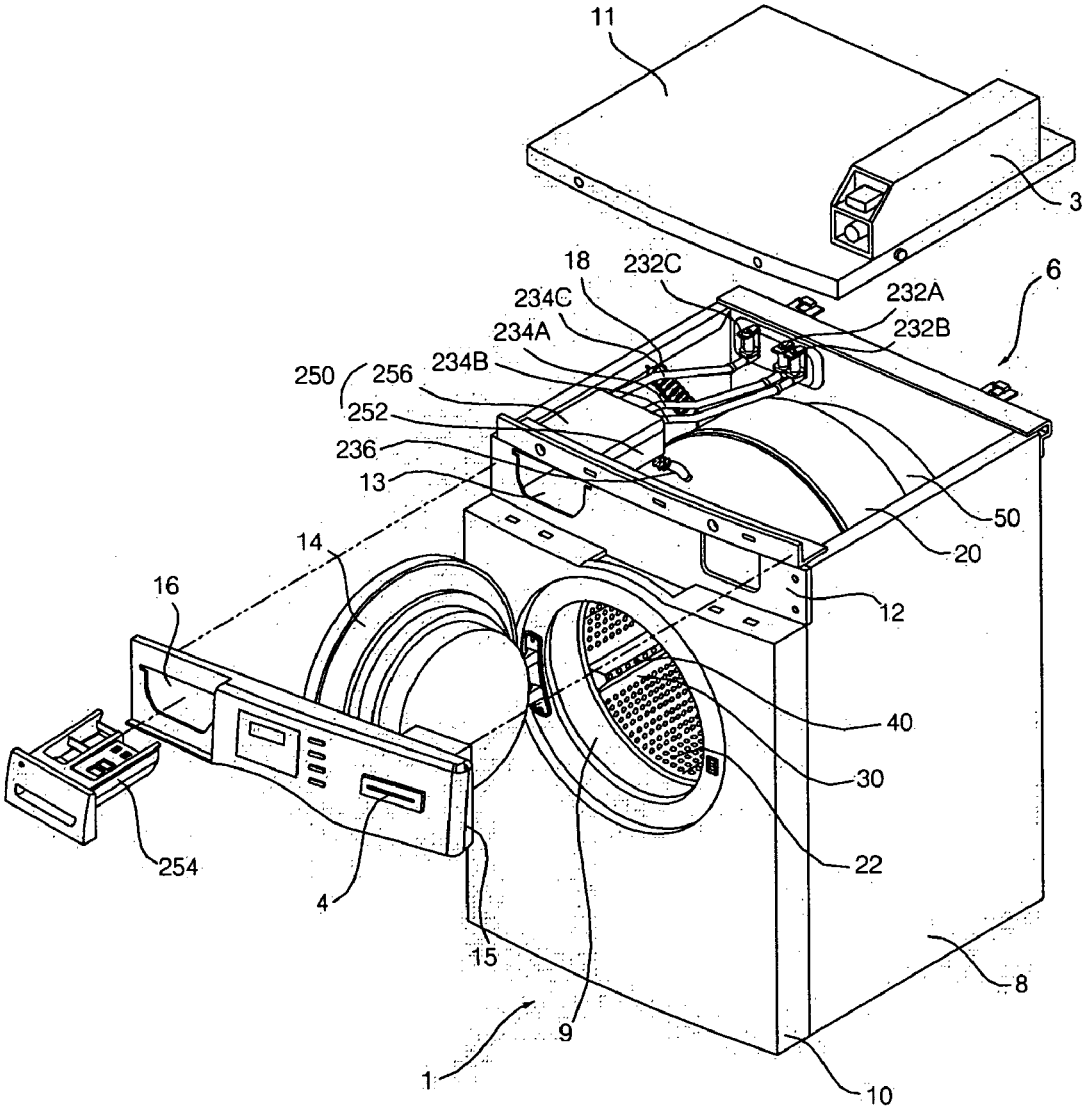
FIG. 5 is an exploded prospective view of main parts of the commercial drum type washing machine shown in FIG. 1.

FIG. 4 is a sectional view of illustrating the internal construction of the commercial drum type washing machine shown in FIG. 1; FIG. 5 is an exploded prospective view of main parts of the commercial drum type washing machine shown in FIG. 1.

Figure 2:
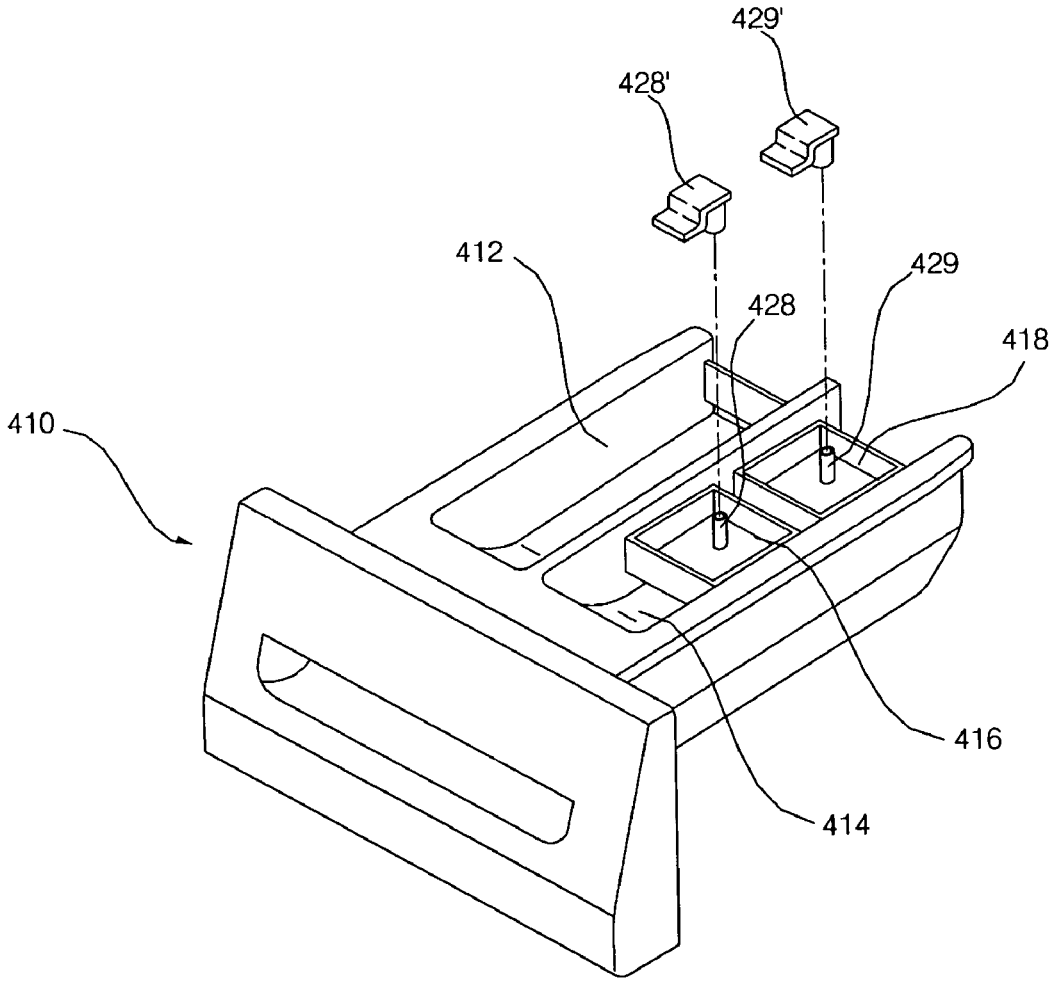
FIG. 2 PRIOR ART
FIG. 2 is a perspective view illustrating another example of a drawer used in a conventional washing machine.

The commercial drum type washing machine 1, as shown in FIGS. 2 and 3, includes a casing 6 which forms its outlook, a tub 20 installed inside the casing 6 to be shock-absorbed by a spring 18 and a damper 19, a drum 30 rotatably arranged inside the tub 20 and having a plurality of perforations 22, a lifter 40 installed on the inner circumference of the drum 30, which lifts laundry by a predetermined height so that laundry can fall down by gravity, and a motor 50 mounted at a rear side of the tub 20, which rotates the drum 30.

The casing includes a base 7, a cabinet 8 installed on an upper side of the base 7, which forms the appearance of the left and right sides and rear side of the commercial drum type washing machine 1, a cover 10 installed on a front side of the cabinet 8 and having an entrance hole 9 formed in its center to place and remove laundry, and a top plate 11 installed on a top surface of the cabinet 8.

On a front and upper side of the cabinet 8 is long formed a supporting frame 12 in the left and right direction to support the left and right sides of the cabinet 8.

On the supporting frame 12 is formed a insert hole 13 for inserting an end of a dispenser housing 252, which will be described later, so that the it is open at its front and rear.

The cabinet cover 10 is installed so that a door 14 may pivotably open/close the entrance hole 9.

On an upper side of the cabinet cover 10 is installed a control panel 15 to display the operating state of the washing machine, and manipulate the operation.

The card reader 4 is installed on the control panel 15.

On the control panel 15 is formed an opening 16 for placing and removing the drawer 254, which will be described later, to be open at its front and rear.

On the other hand, the coin box 3 is installed on a top side of the top plate 11; a buffering pad 17 is provided on a top side of the top plate 11 and the coin box 3 is mounted on the buffering pad 17.

The coin box 3 and card reader 4 are controlled by the control panel 15, and interconnected to be able to communicate with the electromagnetic parts of the control panel 15, so that the circumstances of processing fees may be displayed outside.

Wiring of the coin box 3 penetrates the buffering pad 17 and top plate 11, and then is connected along a bottom of the top plate 11 to the control panel 15 side.

A water supplier 230 is installed over a top side of the tub 20.

The water supplier 230 includes a water supplying valve 232 to control water fed from the external water supplying source, a water supplying hose 234 to guide water passing through the water supplying valve 232, a detergent supplying apparatus 250 for mixing the guided water with any one of detergent, softener, and bleach and draining it, a water supplying bellows 236 to guide water mixed with detergent and the like during passing through the detergent supplying apparatus 250 to the inside of the tub 20; the water supplying valve 232, water supplying hose 234, a part of the detergent supplying apparatus 250, and water supplying bellows 236 form a water supplying passage of the washing machine.

The water supplying valve 232 is installed to penetrate a rear and upper side of the cabinet 8, and consists of cold water valves 232A, 232B through which cold water is supplied from the external, and a hot water valve 232C through which hot water is supplied from the external.

The cold water valves 232A, 232B are formed to have one entrance and two exits, and the hot water valve 232C is formed to have one entrance and one exit.

The detergent supplying apparatus 250 is communicatably coupled between the water supplying hose 234 and bellows 236 so that detergent may be supplied to the tub 20 along with water from the water supplier 230.

The water supplying hose 234 is installed between the water supplying valve 232 and detergent supplying apparatus 250 to guide water to the detergent supplying apparatus 250, and consists of a first and second cold hose 234A, 234B coupled between the cold water valves 232A, 232B and detergent supplying apparatus 250, and a hot water hose 234C coupled between the hot water valve 232C and detergent supplying apparatus 250.

Below the tub 20 is installed a water drainer 240, as shown in FIG. 4, to drain contaminated water used in washing and rinsing or dehydrated water (hereinafter, referred to as 'washing water') out of the washing machine.

The water drainer 240 comprises a water drain bellows 242 connected to an overflow of the tub 20, a water drain pump 244 connected to the water drain bellows 242, and a water drain hose 246 to guide washing water pumped by the water drain pump to the outside of the washing machine.

Figure 6:
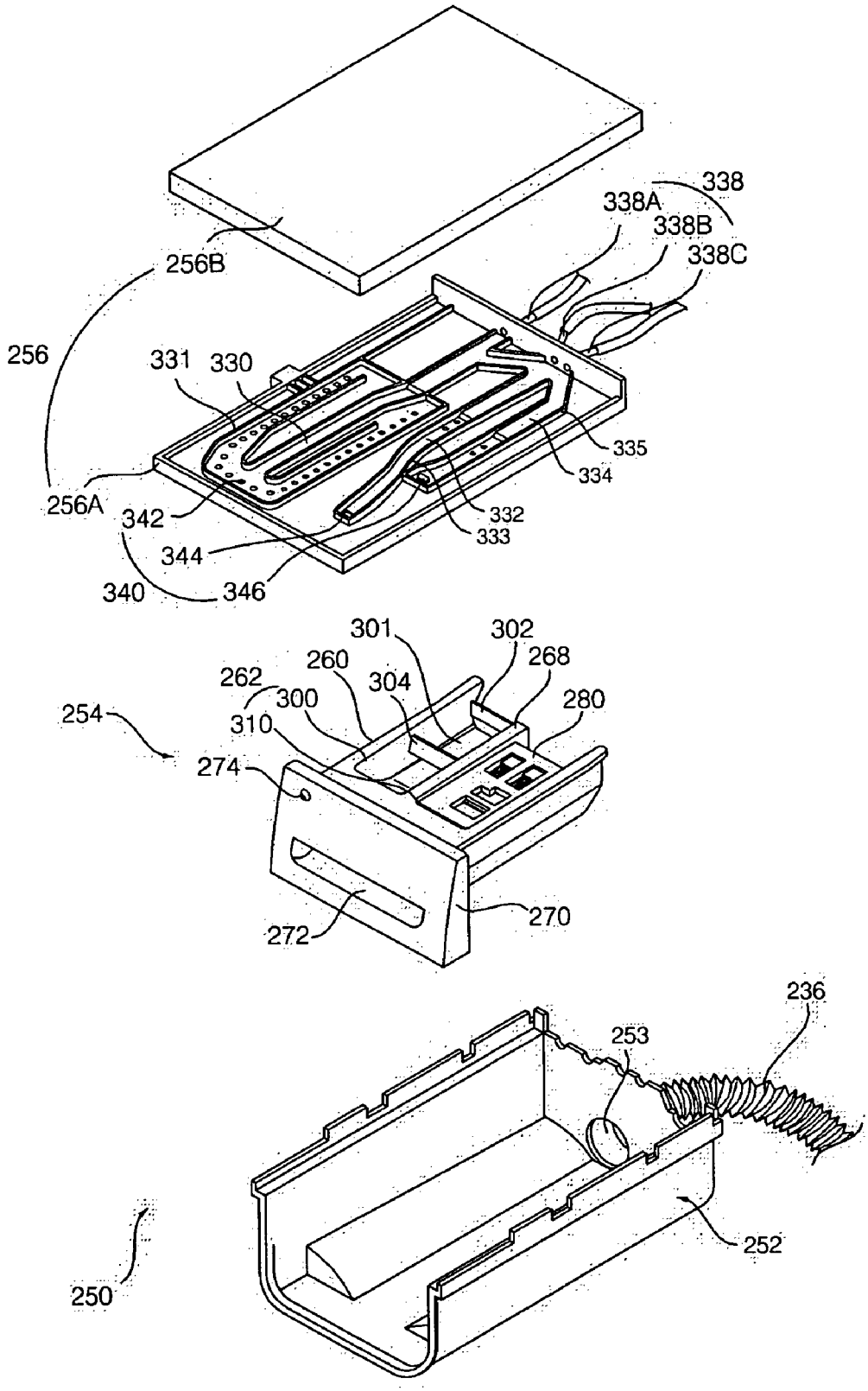
FIG. 6 is an exploded prospective view of the detergent supplying apparatus shown in FIG. 5.
Figure 7:
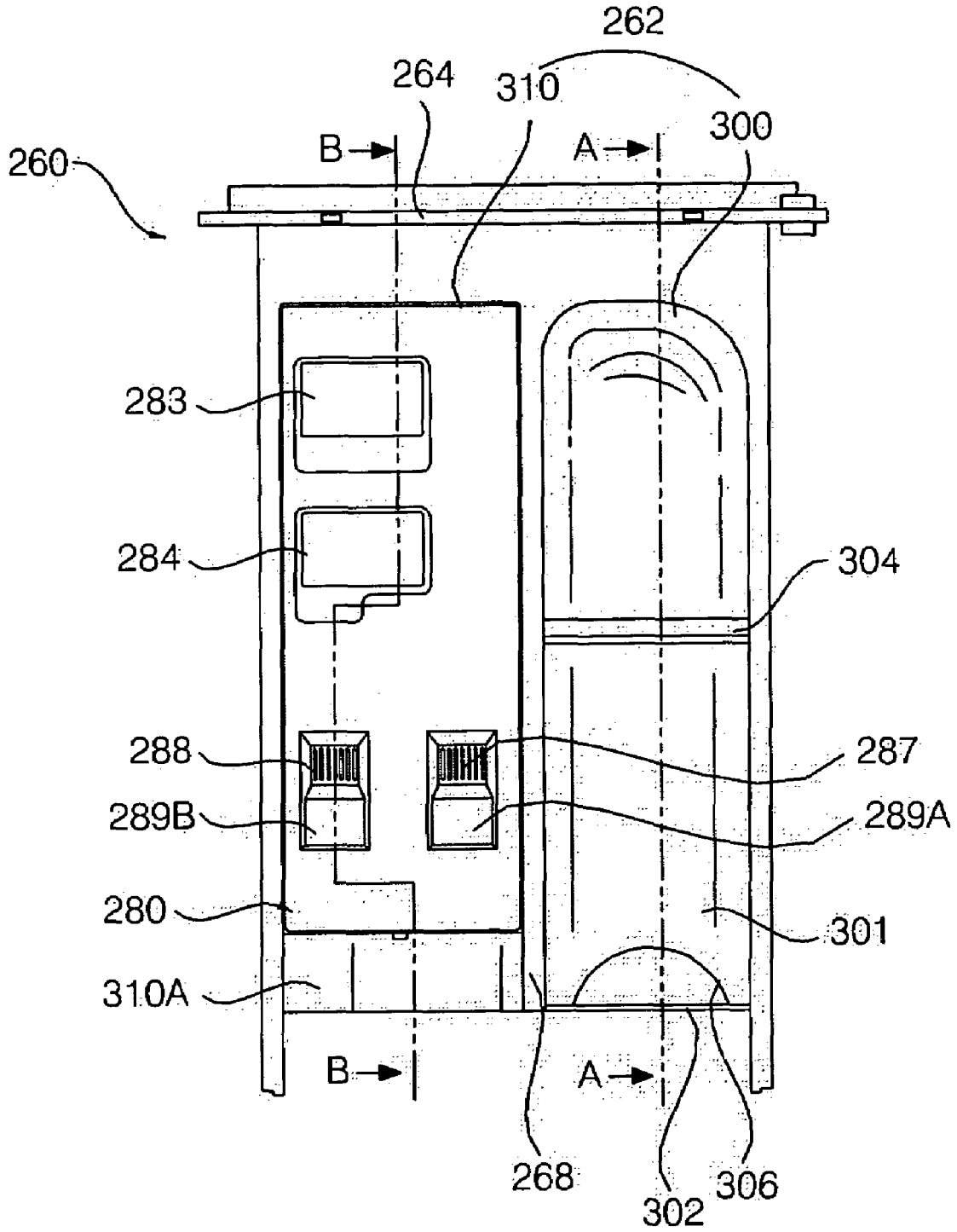
FIG. 7 is a plane view of the drawer shown in FIG. 6.
Figure 8:
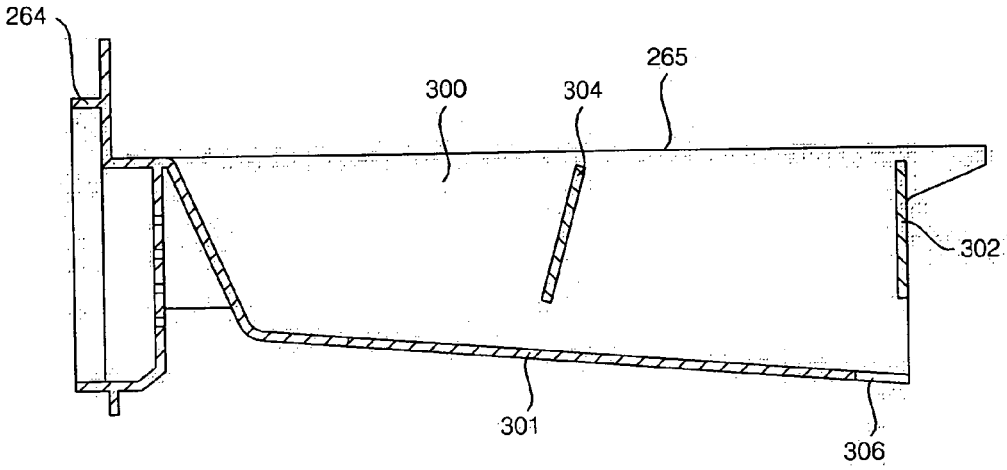
FIG. 8 is a sectional view taken along line A-A of FIG. 7.
Figure 9:
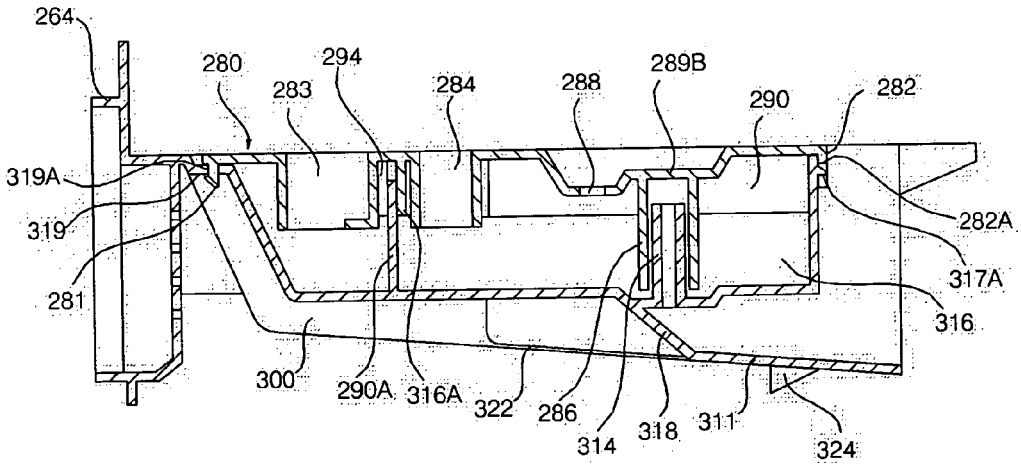
FIG. 9 is a sectional view taken along line B-B of FIG. 6.
Figure 10:
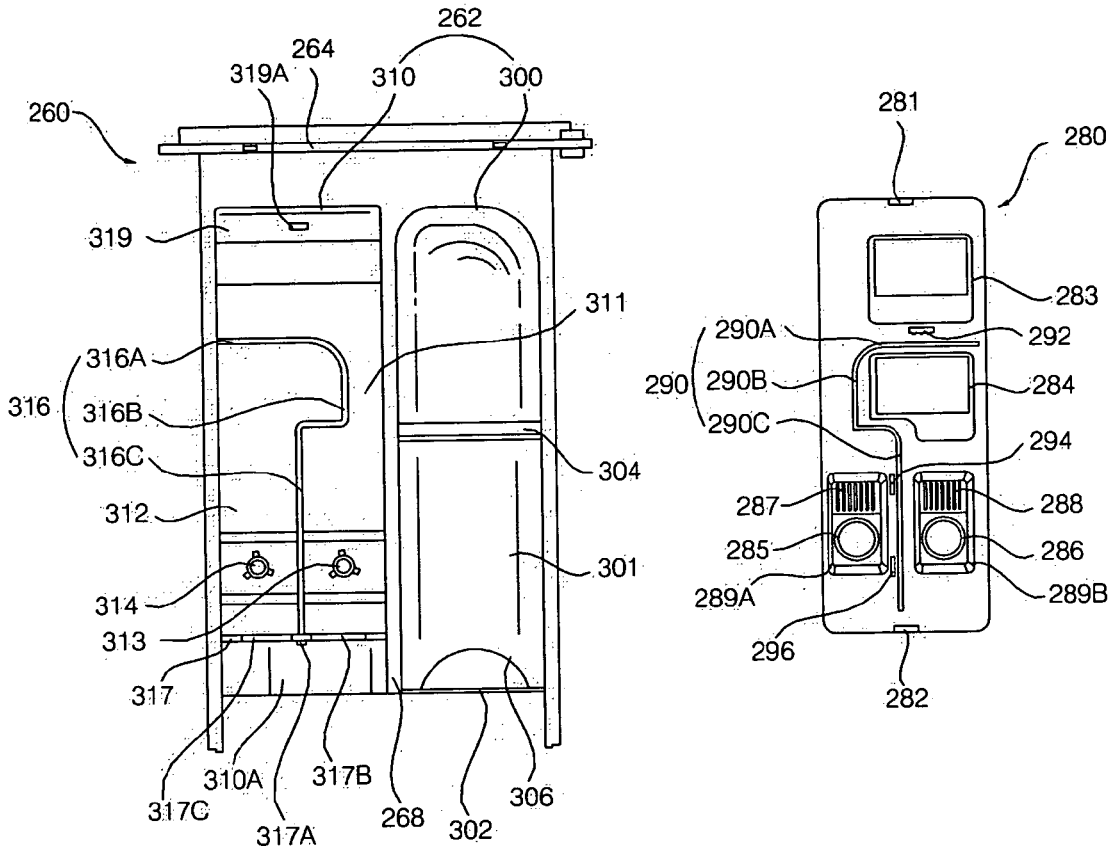
FIG. 10 is a view of illustrating the drawer and drawer cap shown in FIG. 6, which are disassembled from each other.

FIG. 6 is an exploded prospective view of the detergent supplying apparatus shown in FIG. 5, FIG. 7 is a plane view of the drawer shown in FIG. 6, FIG. 8 is a sectional view taken along line A-A of FIG. 7, FIG. 9 is a sectional view taken along line B-B of FIG. 6, and FIG. 10 is a view of illustrating the drawer and drawer cap shown in FIG. 6 which are disassembled from each other.

The detergent supplying apparatus 250, as shown in FIG. 6, comprises a dispenser housing 252 connected to the water drain bellows 236, which is open at its front and top, a drawer 254 to store and supply detergent, softener, and bleach, and a dispenser cover 256 mounted at the open top surface of the dispenser housing 252 and communicatably coupled to the water supplying hose 234 to supply water to the inside of the drawer 254.

The dispenser housing 252 is installed on a rear surface of the supporting frame 12 so that its front surface may communicate with the opening 16 of the control panel 15.

The overflow 253 in the dispense housing 252, which is connected to the water supplying bellows 236, is protruded so that a mixture of water and detergent, etc. dropping from the drawer 254 may be supplied to the inside of the tub 20.

The drawer 254 is inserted inside the dispenser housing 252, which is a water supplying passage of the washing machine, through the opening 16 of the control panel 16 and the opening 13 of the supporting frame 12, and arranged in the water supplying passage of the washing machine or drawn to the external.

The drawer 254 comprises a main body 260 provided with a detergent supplying part 262 for storing and supplying detergent, softener, and bleach, and a front panel 270 combined with the front surface of the main body 260 and having a handle 272 formed on its front side.

The main body 260 has a front surface part 264 formed on its front surface; the front panel 270 is mounted on the front surface part 264.

In the drawer 254, especially the main body 260 of the drawer 254, are provided a detergent supplying part 300 for storing and supplying detergent and a bleach/softener supplying part 310 for storing and supplying at least either of softener and bleach, respectively, and a connection section 268 is formed between a top side of the detergent supplying part 300 and a top side of the bleach/softener supplying part 310.

The detergent supplying part 300 is formed to have nearly the same area as the overall area of the bleach/softener supplying part 310.

The detergent supplying part 300 is generally formed in a box form, which is open at its top and rear surfaces.

The detergent supplying part 300 has a cutoff wall 302 formed on its rear surface, which prevents powdered detergent from falling to the dispenser housing 252 with detergent caked by water jetted from the dispenser cover 256.

A detergent amount setting wall 304 is formed at a location spaced by a predetermined distance from the front panel 270 toward the rear side in order to set up the amount of detergent capable of being accommodated by the detergent supplying part 300.

The cutoff wall 302 and detergent amount setting wall 304 are a plate shape member formed horizontally in the left and right direction; its left and right ends are, respectively, connected to the left and right walls of the detergent supplying part 300, and it is formed to be spaced from a bottom surface 301 of the detergent supplying part 300 by a predetermined distance so that detergent accommodated in the detergent supplying part 300 may be discharged into the dispenser housing 252.

The detergent supplying part 300 has a discharge hole unit 306 with a semi-circular shaped at a lower side of the cutoff wall 302 in order to easily discharge water from the detergent supplying part 300.

The detergent amount setting wall 304 is formed at a location corresponding to the opening 16 of the control panel 15 when the drawer 254 is drawn maximally extent toward the front side of the opening 16 of the control panel 15, and sets up a space where detergent is placed in the detergent supplying part 300.

The detergent amount setting wall 304 is formed vertically at a location corresponding to the opening 16 of the control panel 15 when the drawer 254 is drawn maximally, and confines the capacity of detergent capable of being accommodated in the detergent supplying part 300.

The detergent amount setting wall 304 is formed to be inclined up and down so that its upper end is arranged at the rear side of the control panel 15 and its lower end is arranged at the front side of the opening 16.

Since the detergent amount setting wall 304 is formed to be inclined, it is possible to easily eject a injection mold of the main body 260 during injection molding; since the upper end of the detergent amount setting wall 304 is placed inside the opening 16 of the control panel 15, it is possible to prevent powdered detergent from being injected into a rear space of the detergent amount setting wall 304 in advance.

The detergent supplying part 310 is generally formed in a box form, which is open at its top and rear surfaces.

The bleach/softener supplying part 310 has a bleach supplying part 311 for storing bleach and a softener supplying part 312 for storing softener formed long in the front and rear direction.

The bleach supplying part 311 and softener supplying part 312 are formed in a box form at a location where their rear side is spaced by a predetermined height from the bottom surface 310A of the bleach/softener supplying part 310 toward their upper side, which are open at their top surface.

The bleach supplying part 311 has a siphon tube 313 for bleach protruded by a predetermined height on the bottom surface of its rear side.

The softener supplying part 312 has a siphon tube 314 for bleach protruded by a predetermined height on the bottom surface of its rear side.

The bleach/softener supplying part 310 is provided with a drawer partition rib 316 which forms a wall surface part of the bleach supplying part 311 and softener supplying part 312 and partitions the bleach supplying part 311 and softener supplying part 312.

The drawer partition rib 316 partitions the bleach supplying part 311 and softener supplying part 312 so that one 311 is placed before the other 312.

The drawer partition rib 316 consists of a first lower side partition rib 316A, a second lower side partition rib 316B, and a third lower side partition rib 316C; the first lower side partition rib 316A is formed long in the left and right direction from the left side wall part of the bleach/softener supplying part 310 toward its right side wall part, the second lower side partition rib 316B is formed long from the first lower side partition rib 316A rearward, and the third lower side partition rib 316C is formed from the lower end of the second lower side partition rib 316B toward the left to be parallel to part of the first lower side partition rib 316A and then formed long rearward.

The drawer partition rib 316 is formed so that the left and right width of the front side of the bleach supplying part 311 is greater than that of its rear side, and the left and right width of the front side of the softener supplying part 312 is greater than that of its rear side; this allows bleach to be easily put in the front side of the bleach supplying part 311, and allows softener to be easily put in the front side of the softener supplying part 312.

That is, the first lower side partition rib 316A is formed long in the right direction from the left wall part of the bleach/softener supplying part 310 toward its right wall part; it is formed longer than a half of a width between the left wall part and right wall part of the bleach/softener supplying part 310.

The second lower side partition rib 316B is formed long from the right end of the first lower side partition rib 316B rearward; the width between the left side wall part of the bleach/softener supplying part 310 and the second lower side partition rib 316B is formed greater than that between the right side wall part of the bleach/softener supplying part 310 and the second lower side partition rib 316B.

And, the third lower side partition rib 316C is formed in the left direction from the rear end of the second lower side partition rib 316B toward the left side wall part of the bleach/softener supplying part 310, and formed long from the midpoint of the left and right side wall parts of the bleach/softener supplying part 310 rearward.

The bleach/softener supplying part 310 has a bottle neck between the second lower side partition rib 316B and its right side wall part; considering the bottle neck, it is desirable to have the bottle neck so that the bleach supplying part 312 is placed at a side and in front of the bleach supplying part 311 because viscosity of water mixed with softener is generally greater than that of water mixed with bleach.

That is, in the bleach/softener supplying part 310, the bleach supplying part 311 is located at a side and in front of the softener supplying part 312, the front side of the bleach supplying part 311 is formed in left and right width greater than its rear side, and the front side of the softener supplying part 312 is formed in left and right width greater than its rear side, and this allows for readily injecting bleach or softener while minimizing drawn distance of the drawer 254.

Meanwhile, the bleach/softener supplying part 310 has a siphon tube 313 protruded upwardly from the bottom surface of the bleach supplying part 311, and a siphon tube 314 protruded upwardly from the bottom surface of the softener supplying part 314.

The siphon tube 313 for bleach and siphon tube 314 for softener are formed to be spaced from each other with respect to the drawer partition rib 316; the one 313 is placed in the right side of the third lower side partition rib 316C, and the other 314 is placed in the left side of the third lower side partition rib 316C.

The bleach/softener supplying part 310 is provided with a rear wall part 317 of forming a rear surface part of the bleach supplying part 311 and softener supplying part 312.

The rear wall part 317 has overflowing parts 317B, 317C formed at a mid-part of its upper end, each serving to allow bleach and softener or water to be overflown into the dispenser housing 252 in a case where bleach or softener is over-injected, or water is over-supplied.

The overflowing parts 317B, 317C are formed to have relatively lower height than the other parts of the rear wall part 317.

On the other hand, the bleach supplying part 311 and softener supplying part 312 are formed so that region, where the siphon tube 313 for bleach and siphon tube 314 for softener are formed, are sank to the bottom deeply by a constant depth, and a shielding wall 318 is formed on the bottom surface of the bleach/softener supplying part 310, which may shield low the lower and front side of the siphon tube 313 for bleach and siphon tube 314 for softener.

The shielding wall 318 is formed at a location spaced by a predetermined distance from the siphon tubes 313, 314 toward so that when the drawer 254 is inserted into the opening 16 of the control panel 15, air pressure may operate on the lower side of the siphon tubes 313, 314.

Therefore, when the drawer 254 closing, predetermined air pressure operates on the lower side of the siphon tubes 313, 314, and this makes it possible to prevent a phenomenon that bleach and softener stored in the bleach supplying part 311 and softener supplying part 312 are drained through the siphon tubes 313, 314 and siphon caps 285, 286, which will be described later, into the bottom surface 310A of the bleach/softener supplying part 310.

On the other hand, the front panel 270 is hooked on the front surface part 264 in the main body 260 of the drawer, and connected and fastened by a connecting bolt 274.

That is, on the front surface part 264 of the drawer main body 260 and front panel 270 are formed a hook hole and a hook facing the hook hole, which combine the front panel 270 to the front surface part 264 of the drawer main body 260, and a connecting hole or boss and a connecting bolt facing the connecting hole or boss, which connect and fasten the front panel 270 to the front surface part 264 of the drawer main body 260. Therefore, the front panel 270 is securely fixed to the front surface part 264 of the drawer main body 260 and not easily parted from the drawer main body 260.

On the other hand, on the drawer 256 is installed a drawer cap 280 for covering the top surface of the bleach/softener supplying part 310.

The drawer cap 280 has the size and shape to cover both the top surface of the bleach supplying part 311 and the top surface of the softener supplying part 312.

The drawer cap is a member in a plate shape, which is mounted to cover the top surface of the bleach/softener supplying part 310, and its front side is placed and fixed on a placing part 319 formed on the front side of the bleach/softener supplying part 310 in a stepwise manner, and its rear side is placed and fixed on the upper end of the rear wall part 317 formed on the rear surface of the bleach/softener supplying part 310.

The drawer cap 280 has a hook 281 protruded downwardly from the bottom surface of its front side, and the front surface part 264 has the hook hole 319A penetratingly formed in the upper and lower direction, on which the hook 281 inserted into the placing part 319 is locked.

The drawer 264 has a protrusion 317A projected rearward from the upper and rear surface of the rear wall part 317, and the drawer cap 280 has a locking hole 282A formed on its rear wall part 317, which is locked by the protrusion 317A, and a locking part 282 protruded and tightly contacted on the rear surface of the rear wall part 317.

The locking part 282 is formed to tightly contact the upper and rear surface of the rear wall part 317.

Hanging the locking hole 282A to the protrusion 317A while placing the locking part 282 in the rear side of the rear wall part 317 and then inserting the hook 281 into the hook hole 219A by pressing the front side of the drawer cap 280 downwardly, this enables the drawer cap 280 to be securely mounted to the drawer 254, and prohibits the hook 281 and protrusion 317A to be exposed outside when the drawer 254 is drawn, which allows a user to limit the removal of the drawer cap 280.

On the other hand, the drawer cap 280 had a bleach input port 283, through which bleach and water are injected, formed to correspond to the front side of the bleach supplying part 311, and a softener input port 284, through which softener and water are injected, formed to correspond to the front side of the softener supplying part 312.

The bleach input port 283 and softener input port 284 are formed on the front side of the drawer cap 280 to be open up and down; the bleach input port 283 is located in front of the softener input port 284.

The bleach input port 283 and softener input port 284 in the drawer cap 280 are projected downward than their perimeters, and formed in a box form which has a rectangular hole in its center.

The drawer cap 280 has a bleach siphon cap 285 formed in a region corresponding to the bleach siphon tube 313 of the bleach supplying part 311, which covers the bleach siphon tube 313, and a softener siphon cap 286 formed in a region corresponding to the softener siphon tube 314 of the softener supplying part 312, which covers the softener siphon tube 314.

The bleach siphon cap 285 and softener siphon cap 286 are formed to be spaced in the left and right direction.

The drawer cap 280 has elevated portions 289A, 289B, each formed in regions where the bleach siphon cap 285 and softener siphon cap 286 are formed and elevated downward by a predetermined depth.

On the other hand, the drawer cap 280 has a water supplying hole 287 for bleach, through which water falling from the dispenser cover 256 toward the bleach supplying part 311 passes, and a water supplying hole 288 for softener, through which water falling from the dispenser cover 256 toward the softener supplying part 312 passes, respectively.

The water supplying hole 287 for bleach and the water supplying hole 288 for softener are projected from the elevated portions 289A, 289B downward in a rectangular structure, and each of them is integrally formed with a plurality of grills.

In the drawer cap 280, water fallen from the dispenser cover 256 passes through the water supplying hole 287 for bleach and supplied into the bleach supplying part 311, promoting the dilution of bleach, and water fallen from the dispenser cover 256 passes through the water supplying hole 288 for softener and supplied into the softener supplying part 312, promoting the dilution of softener.

The drawer cap 280 has a drawer cap partition rib 290 tightly contacted with the drawer partition rib 316 of the drawer main body 260 on its bottom surface and protruded downward.

The drawer cap partition rib 290 consists of a first upper side partition rib 290A, a second upper side partition rib 290B, and a third upper side partition rib 290C; the first upper side partition rib 290A is formed in the left and right direction so as to tightly contact the first lower side partition rib 316A, the second upper side partition rib 290B tightly contacts the second lower side partition rib 316A, and the third upper side partition rib 290C is partly formed in the left and right direction and parallel to part of the first upper side partition rib 290A and then extended long from the mid-point of the drawer cap 280 downward so as to tightly contact the third lower side partition rib 316C.

The first upper side partition rib 290A is formed to tightly contact the rear surface of the first lower side partition rib 316A.

The second upper side partition rib 290B is formed long from the right end of the first upper side partition rib 290A rearward to tightly contact the left surface of the second lower side partition rib 316B.

The third upper side partition rib 290C is formed to tightly contact the front and left surfaces of the third lower side partition rib 316C.

In the drawer cap 280, the bleach input port 283 and softener input port 284 are formed to be spaced in the front and rear with respect to the first upper side partition rib 290A.

On the front side of the first upper side partition rib 290A is protruded a first fitting rib 292, which is tightly contacted on the front surface of the first lower side partition rib 316A, and on the right side of the third upper side partition rib 290C are protruded a second and third fitting rib 294, 296, which are tightly contacted on the right surface of the third lower side partition rib 316C.

When the drawer cap 280 is mounted, the first lower side partition rib 316A is fitted between the first upper side partition rib 290A and the first fitting rib 292, and the third lower side partition rib 316C is fitted between the third upper side partition rib 290C and the second and third fitting rib 294, 296.

The dispenser cover 256, as shown in FIG. 4, consists of a lower panel 256A mounted on an open upper surface of the dispenser housing 252, and an upper panel 256B placed and mounted on a top side of the lower panel 256A so as to a water supplying passage 330 for detergent, a water supplying passage 332 for bleach, and a water supplying passage 334 for softener together with the lower panel 256A.

The lower panel 256A has a hose connection part 338 connected to the water supplying hose 234 of the water supplier 230 and protruded rearward.

The hose connection part 338 consists of a first hose connection part 338A connected to a hot water hose 234C so as to supply hot water to the water supplying passage 330 for detergent, and a second and third hose connection part 338B, 338C connected to a first and second cold water hose 234A, 234B so as to supply cold water to the water supplying passage 332 for bleach, water supplying passage 334 for bleach, and water supplying passage 330 for detergent.

The lower panel 256A is formed with a plurality of water supplying holes 340 in a region corresponding to the detergent supplying part 300 and bleach/softener supplying part 310 of the drawer 254 so as to supply water.

The water supplying holes 340 consist of a plurality of detergent water supplying hole 342 formed on the top side of the detergent supplying part 300 so as to supply water in the water supplying passage 330 for detergent to the detergent supplying part 300, a plurality of bleach water supplying hole 344 formed on the top side of the bleach supplying part 311 so as to supply water in the water supplying passage 332 for bleach to the bleach supplying part 311, and a plurality of softener water supplying hole 346 formed on the top side of the softener supplying part 312 so as to supply water in the water supplying passage 334 for softener to the softener supplying part 312.

The detergent water supplying hole 342 is formed on a region corresponding to the inner surface of the detergent supplying part 300 in plurality, the bleach water supplying hole 344 is formed on a region corresponding to the bleach input port 283 and water supplying hole 287 for bleach, respectively, and the softener water supplying hole 346 is formed on a region corresponding to the softener input port 284 and water supplying hole 288 for softener, respectively.

The dispenser cover 256 has the water supplying passage 330 for detergent formed so that hot or cold water flows from the first, second, and third hose connection part 338A, 338B, 338C to the detergent water supplying hole 342, the water supplying passage 332 for bleach formed so that cold water flows from the second and third hose connection part 338B, 338C to the bleach water supplying hole 344, and the water supplying passage 334 for softener formed so that cold water flows from the second and third hose connection part 338B, 338C to the softener water supplying hole 346.

The water supplying passage 330 for detergent, water supplying passage 332 for bleach, and water supplying passage 334 for softener are formed so that regions where the detergent water supplying hole 342, bleach water supplying hole 344, and softener water supplying hole 346 are formed are elevated downward by a predetermined depth than the other regions.

The regions where the detergent water supplying hole 342, bleach water supplying hole 344, and softener water supplying hole 346 are formed have increased water storing capacity and prevents water from flowing backward to the first, second, and third hose connection part 338A, 338B, 338C therefrom.

At least either of the upper panel 256B or lower panel 256A is protrudingly formed with a detergent water supplying rib 331 forming the water supplying passage 330 for detergent, a bleach water supplying rib 333 forming the water supplying passage 332 for detergent, and a softener water supplying rib 335 forming the water supplying passage 334 for softener.

The upper panel 256B and lower panel 256A are assembled by melting bond.

Figure 11:
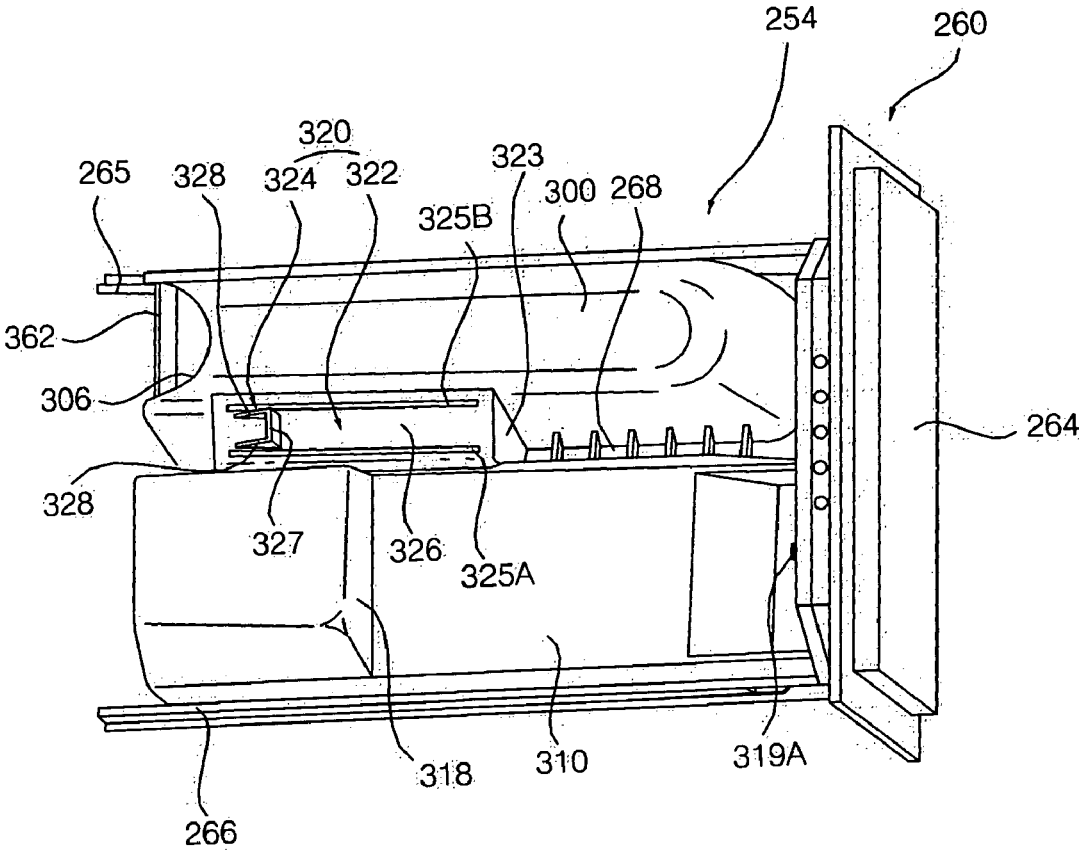
FIG. 11 is a prospective view of illustrating a bottom side of the drawer shown in FIG. 6.
Figure 12:
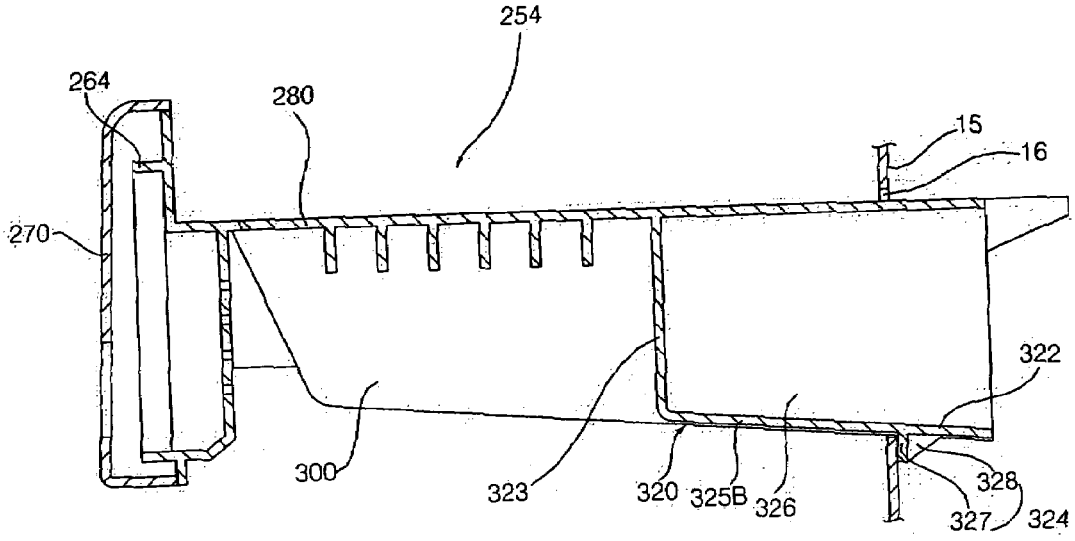
FIG. 12 is a sectional view of illustrating an appearance in which the drawer shown in FIG. 11 is locked to a lower side of an opening of the commercial drum type washing machine.

FIG. 11 is a prospective view of illustrating a bottom side of the drawer shown in FIG. 6, and FIG. 12 is a sectional view of illustrating an appearance in which the drawer shown in FIG. 11 is locked to a lower side of an opening of the commercial drum type washing machine.

The detergent supplying apparatus 250 has a stopper formed on at least either of the drawer 254 and drawer cap 280, which serves to prevent the drawer 254 from being easily removed from the washing machine.

The stopper 320, a kind of removal preventing means, which may set up a maximum drawn distance because it is locked to the lower side of the opening 16 of the control panel 15 when being pulled toward, and allows the drawer 254 to be totally removed from the washing machine 1, if necessary, is formed to be locked at a perimeter of the opening 16 of the control panel 15 in the drawal direction of the drawer 254.

The stopper 320 may be integrally formed not only with the drawer 254, especially, the drawer main body 260, but also with the drawer cap 280.

It is most preferable that the stopper 320 is integrally formed with the drawer 254, since if the drawer cap 280 were in the state removed or lost from the drawer 254, in case that the stopper 320 is formed on the drawer cap 280, then the drawer 254 could be separated freely because there is no structure in the drawer 254 itself to confine the removal.

Moreover, the stopper 320 may be formed not only on the top side of the drawer 254 but also on the bottom side of the drawer 254.

In case that the stopper 320 is formed on the top side of the drawer 254, for example, the connection part 265, or on the top surface of the detergent supplying part 300 or bleach/softener supplying part 310, the stopper 320 may be readily recognized by a general user, which provides a possibility that the user would separate the drawer 254 without confining the stopper 320 to the washing machine, therefore, it is most preferable that the stopper 320 is formed on the bottom side, where user can not easily recognize the stopper 320.

That is, the stopper 320 is formed on the bottom side of the drawer 254, which allows the stopper 320 not to be exposed when the drawer 254 is drawn, and the stopper 320 is integrally formed with the drawer 254, which allows the stopper 320 not to be easily removed.

The stopper 320 consists of a panel part 322 formed to be pressed elastically between the bottom surface of the detergent supplying part 300 and the bottom surface of the bleach/softener supplying part 310, and a protrusion 324 projected downward on the panel part 322 so as to be locked to the lower side of the opening 16 of the control panel 15 when the drawer 254 is drawn.

The stopper 230 further comprises a supporting part 323 of coupling the panel part 322 and the connecting part 268.

The panel part 322 is a plate shape member integrally injection-molded on the bottom side of the drawer main body 260, and its left and right sides are connected to the bottom side of the detergent supplying part 300 and bleach/softener supplying part 310, and its nearly mid-part is formed with an elastic part 326 elastically deformed in the upper and lower direction.

The panel part 322 is formed horizontally in the rear and lower side of the drawer main body 260; it is formed long in the front and rear direction between the detergent supplying part 300 and bleach/softener supplying part 310.

Two slits 325A, 325B, respectively, are formed in the left and right sides of the panel part 322 at locations spaced from the detergent supplying part 300 and bleach/softener supplying part 310.

The left side slit 325A and right side slit 325B are formed in the longitudinal direction of the panel part 322, and the elastic part 326 is formed between the left side slit 325A and right side slit 325B so as to be capable of being pressed.

The elastic part 326 is connected to the left side slit 325A and right side slit 325B at its left side and right side, respectively, and elastically connected to the panel part 322 at its front and rear sides.

The mid-part of the elastic part 326 is elastically deformed convexly upward as depressed.

The protrusion 324 is projected from the rear side of the elastic part 326 downward by a predetermined height so that the rear side of the drawer 254 is placed in the rear side of the opening 16 of the control panel 15.

The protrusion 324 is composed of ribs projected from the rear and bottom surface of the elastic part 326 in the shape of 'ㄷ'.

The protrusion 324 consists of a vertical rib 327 formed on the bottom surface of the elastic part 326 in the left and right direction, and inclined ribs 328, each formed from the left and right sides of the vertical rib 327 rearward.

The vertical rib 327 is protruded vertically from the bottom surface of the elastic part 326 so as to be locked to the lower side of the opening 16 when the drawer 254 is drawn.

The inclined ribs 328 support the vertical rib 327, and are formed to be inclined upward as the vertical rib 327 goes to its rear side, so that the drawer 254 may be readily inserted and mounted to the opening 16.

It is preferable that the protrusion 324 is positioned biased to the rear side with respect to the mid-point of the front and rear direction of the elastic part 326, so that the front end of the inclined rib 328 is greatly deformed to the upside in comparison with its rear end when the drawer 254 is inserted and mounted.

An operation of the detergent supplying apparatus of the commercial drum type washing machine according to the present invention configured as above will be described below.

First, if a user draws the drawer 254 toward the opening 16 of the control panel 15, then the drawer 254 passes through the opening 16 of the control panel 15 and is drawn to the front side.

In case that a part of the drawer 254 is exposed to the front side, the front side of the detergent supplying part 300 is exposed outside, and the front side of the drawer cap 280, especially, the bleach input port 283 and softener input port 284 are exposed outside.

If the user injects detergent trough the front side of the detergent supplying part 300 of the drawer 254, then detergent is accommodated in the detergent supplying part 300; If the user injects bleach into the bleach input port 283 of the drawer cap 280, then bleach is accommodated in the bleach supplying part 311; If the user puts softener into the softener input port 284 of the drawer cap 280, then softener is accommodated in the softener supplying part 312.

As described above, if the drawer 254 is pushed rearward the opening 16 of the control panel 15, with detergent, bleach, and softener injected in the detergent supplying part 262 of the drawer 254, then the drawer 254 is inserted deeply inside the dispenser housing 252.

And, if the user sets up a washing course or washing time by manipulating the control panel 15, then the washing machine evaluates fee depending on the set washing course and washing time, displays it through the control panel 15 or fee processing device 110, and then, if the user settles the payment of fee by the fee processing device 110, the washing machine 1 becomes a state, where the user may operate the washing machine 1; the washing machine 1 is operated by the user's manipulation through the control panel 15 and performs the washing course set by the user.

Hereafter, a procedure of water supplying through the water supplier 230 will be described below.

First, if the water supplying valve 232 becomes on, then water from the external passes through the water supplying valve 232 and subsequently water supplying hose 234, and then is supplied to the inside of the dispenser cover 256 in the detergent supplying apparatus 250.

Water supplied to the inside of the dispenser cover 256 falls to the drawer 254 along any one of the water supplying passages 330, 332, 334 and any one of the water supplying holes 342, 344, 346.

Water guided to the water supplying passage 330 for detergent in the dispenser cover 256 passes through the detergent water supplying hole 342, falls to the inside of the detergent supplying part 310, flows to the rear side of the detergent supplying part 310 while mixed with detergent stored in the detergent supplying part 310, falls to the lower side of the dispenser housing 252, and is supplied through the water supplying bellows 236 to the tub 20.

On the other hand, water guided into the water supplying passage 332 for bleach of the dispenser cover 256 falls through the bleach water supplying hole 344 to the lower side. Water having passed through the bleach water supplying hole 344 located in the front side among the bleach water supplying hole 344 passes through the bleach input port 283 of the drawer cap 280 and then is supplied to the front side of the bleach supplying part 311; water having passed through the beach water supplying hole 344 located in the rear side among the bleach water supplying hole 344 passes though the bleach water supplying hole 287 of the drawer cap 280 and then is supplied to the rear side of the bleach supplying part 311.

Water supplied to the bleach supplying part 311 is mixed with bleach, discharged through the bleach siphon tube 313 and bleach siphon cap 285, falls to the lower side of the dispenser housing 252, and then is supplied through the water supplying bellows 236 to the tub 20.

On the other hand, water guided into the water supplying passage 334 for softener of the dispenser cover 256 falls through the softener water supplying hole 346 to the lower side. Water having passed through the softener water supplying hole 346 located in the front side among the softener water supplying hole 346 passes through the softener input port 284 of the drawer cap 280 and then is supplied to the front side of the softener supplying part 311; water having passed through the softener water supplying hole 346 located in the rear side among the softener water supplying hole 346 passes though the softener water supplying hole 288 of the drawer cap 280 and then is supplied to the rear side of the softener supplying part 312.

Water supplied to the softener supplying part 312 is mixed with softener, discharged through the softener siphon tube 314 and softener siphon cap 286, falls to the lower side of the dispenser housing 252, and then is supplied through the water supplying bellows 236 to the tub 20.

Although the detergent supplying apparatus of the washing machine according to the present invention is described with reference to the exemplary drawings, the invention is not limited to the embodiments and drawings set forth herein, rather it is limited only to the accompanying claims and many alternatives, modifications, and variations will be apparent to those skilled in the art.

The detergent supplying apparatus of the washing machine according to the present invention configured as above has effects as follows.

In the detergent supplying apparatus of the washing machine according to the present invention, either of the softener supplying part and bleach supplying part is formed to be placed at a side and front of the other in the drawer, which allows for making the overall drawer compact while enlarging the size of the detergent supplying part, and allows softener and bleach to be injected while maintaining minimum drawn width of the drawer.

Moreover, in the detergent supplying apparatus of the washing machine according to the present invention, each of the bleach supplying part and softener supplying part is formed so that the left and right width of its front side is greater than that of its rear side, which allows bleach and softener to be easily injected.

Besides, in the detergent supplying apparatus of the washing machine according to the present invention, the overflowing parts are formed on the rear wall part of at least either of the bleach supplying part and softener supplying part, which have relatively lower height than the other parts of the rear wall part, and this allows for preventing bleach or softener from overflowing into other supplying part and making bleach or softener discharged through the rear wall side.

In addition, in the detergent supplying apparatus of the washing machine according to the present invention, the bleach siphon cap for covering the bleach siphon tube and softener siphon cap for covering the softener are formed together at the drawer cap, which allows for minimizing the number of parts and facilitating maintenance compared to a case where the bleach siphon cap and softener siphon cap are separately provided.

What is claimed is:

1. A detergent supplying apparatus of a washing machine comprising:

a drawer having a bleach supplying part and a softener supplying part, the bleach supplying part and softener supplying part each comprising:

a front part and a rear part, wherein a width of each front part is greater than a width of each rear part, and wherein the drawer is partitioned such that one of the bleach supplying part and the softener supplying part extend along a side and a front of the other; and a drawer cap arranged on a top surface of both the bleach supplying part and the softener supplying part, wherein the drawer cap has a bleach input port on a front and upper side of the bleach supplying part and a softener input port on a front and upper side of the softener supplying part.

2. The detergent supplying apparatus of the washing machine of claim 1, wherein each of the bleach supplying part and softener supplying part is formed long in a front and rear direction.

3. The detergent supplying apparatus of the washing machine of claim 1, wherein the drawer is formed with a drawer partition rib for partitioning the bleach supplying part and softener supplying part.

4. The detergent supplying apparatus of the washing machine of claim 3, wherein the drawer partition rib comprises, a first partition rib formed in a left and right direction on an inner and front part of the drawer, a second partition rib formed from the first partition rib rearward, and a third partition rib formed in a left and right direction and in parallel with a part of the first partition rib from the second partition rib, and then formed rearward.

5. The detergent supplying apparatus of the washing machine of claim 3, wherein the drawer has a bleach siphon tube protruded upward on the bleach supplying part and a softener siphon tube protruded upward on the softener supplying part with respect to the drawer partition rib.

6. The detergent supplying apparatus of the washing machine of claim 1, wherein the drawer has an overflowing part having a relatively lower height than the other parts on a rear wall part of at least either of the bleach supplying part and softener supplying part.

7. The detergent supplying apparatus of the washing machine of claim 1, wherein the drawer cap has a size to be capable of the overall top surface of the bleach supplying part and softener supplying part.

8. The detergent supplying apparatus of the washing machine of claim 7, wherein the drawer cap is formed so that a bleach input port and a softener input port are positioned in a front and rear direction to be spaced from each other.

9. The detergent supplying apparatus of the washing machine of claim 1, wherein the drawer is formed so that the bleach supplying part is positioned from a side to a front of the softener supplying part.

10. The detergent supplying apparatus of the washing machine of claim 1, wherein the drawer cap has a bleach siphon cap for covering the bleach siphon tube formed on the bleach supplying part and a softener siphon cap for covering the softener siphon tube formed on the softener supplying part.

11. The detergent supplying apparatus of the washing machine of claim 10, wherein the bleach siphon cap and softener siphon cap are formed to be spaced in a left and right direction.

12. The detergent supplying apparatus of the washing machine of claim 1, wherein the drawer cap has a water supplying hole for bleach, through which water is supplied to the bleach supplying part, and a water supplying hole for softener, through which water is supplied to the softener supplying part.

13. The detergent supplying apparatus of the washing machine of claim 12, wherein the drawer cap is formed so that the bleach water supplying hole and softener water supply hole are spaced in a left and right direction.

14. The detergent supplying apparatus of the washing machine of claim 1, wherein the drawer is formed so that a detergent supplying part is positioned at a side of either of the softener supplying part and bleach supplying part.

15. The detergent supplying apparatus of the washing machine of claim 1, wherein the washing machine is a commercial drum type washing machine.

* * * * *